United States Patent [19]

Sbordone

[11] Patent Number: 5,051,276

[45] Date of Patent: Sep. 24, 1991

[54] DEVICE FOR GRAPHITIZATION OF THE NECK IN CATHODE-RAY TUBE CONES

[75] Inventor: Arturo Sbordone, Anagni, Italy

[73] Assignee: Videocolor, Montrouge, France

[21] Appl. No.: 381,734

[22] PCT Filed: Oct. 14, 1988

[86] PCT No.: PCT/FR88/00509

§ 371 Date: Jun. 16, 1989

§ 102(e) Date: Jun. 16, 1989

[87] PCT Pub. No.: WO89/03583

PCT Pub. Date: Apr. 20, 1989

[30] Foreign Application Priority Data

Oct. 16, 1987 [FR] France ..... 87 14292

[51] Int. Cl.[5] ..... B05C 7/06

[52] U.S. Cl. ..... 427/68; 118/215; 118/244; 118/DIG. 3; 427/230; 427/429

[58] Field of Search ..... 118/214, 215, DIG. 3, 118/230, 232, 244; 427/68, 429, 230

[56] References Cited

U.S. PATENT DOCUMENTS

| | | | |
|---|---|---|---|
| 2,586,348 | 2/1952 | Kuebler | 427/230 |
| 2,709,414 | 5/1955 | Powell et al. | 118/215 |
| 3,108,023 | 10/1963 | Griesemer et al. | 118/215 |
| 4,031,597 | 6/1977 | Nubani et al. | 427/68 |
| 4,092,444 | 5/1978 | Killichowski | 427/68 |

FOREIGN PATENT DOCUMENTS 2382762 9/1978 France .

OTHER PUBLICATIONS

Patent Abstracts of Japan, vol. 10, No. 79 (E-391) (2136) 3-28-86 and JP. A, 60225330 (Toshiba K.K.), Nov. 9, 1985.

Patent Abstracts of Japan, vol. 6, No. 107 (E-113) (985) Jun. 17, 1982 and JP, A, 5738534 (Nippon Denki K.K.) Mar. 3, 1982.

Patent Abstracts of Japan, vol. 3, No. 124 (E-144) Oct. 17, 1979 and JP, A, 54100252 (Sony K.K.) Aug. 7, 1979.

*Primary Examiner*—Willard E. Hoag

*Attorney, Agent, or Firm*—Joseph S. Tripoli; Dennis H. Irlbeck; Vince J. Coughlin

[57] ABSTRACT

A device for the internal graphitization of the surface of the neck in the cone of cathode ray tubes.

A device of this type comprises a frame bearing two arms, such as, capable of rotating around an axis, such as, each bearing a collar, for example, each adapted to a given type of cone. This collar has two functions: that of providing for centering along an axis (xx) of the neck of the cone and that of defining a reference line ($L_r$).

With these arms there cooperate, firstly, a supporting table on which the cone is laid and centered in a horizontal plane and, secondly, a graphitization system such that the brush in its top position reaches a determine upper limit (Lg) and, finally, a combination of means providing for the upward translational motion of the supporting table and of the graphitization system, the regulated descent of the latter, the supporting table remaining still during this stage of descent of the brush.

11 Claims, 5 Drawing Sheets

DEVICE FOR GRAPHITIZATION OF THE NECK IN CATHODE-RAY TUBE CONES

The invention concerns a device that enables the internal graphitization of the surface of the neck in the cone of cathode-ray tubes.

This graphitization operation is aimed at making this internal surface of the neck of the tube conductive to carry it to the same potential (25 Kv) as that of the grid which is in contact with the element commonly called a "top shield cup".

This operation is delicate because, for reasons of operation of the tube, the maximum height of the graphitization in the neck is a vital parameter. Furthermore, the thickness of the graphite layer deposited should be uniform.

For these reasons, the graphitization operations done by hand are not reliable and are increasingly performed by means of automatic machines. Apart from their ability to adjust the height of the graphitization inside the neck, these machines have to be adapted to the cathode-ray tubes according their deflection angle, namely 90° or 110°.

The present invention has precisely the object of resolving all of these problems, and concerns a device for the graphitization of the neck of a cathode-ray tube cone fitted out with means that make it capable of receiving all types of tubes, irrespectively of their deflection angle, said means working together with the graphitization means proper in such a way that said graphitization is done on a well-determined height of the internal surface of the neck, and is done homogeneously.

It concerns, more precisely, a device for the graphitization of the neck in cathode-ray tube cones on a height determined by a plane (Lg); characterized in that it comprises, mounted rotationally on one and the same frame (110), two arms each fitted out with a collar, the profile of which can be adapted to the deflection angles of the cathode-ray tubes, said collars working together with a supporting table capable of being translated in a vertical plane and provided with means for centering the base of the cone in a horizontal plane to, on the one hand, center the neck of the cone along its axis (xx) and, on the other hand, determine a plane acting as a reference plane (Lr) for the graphitization operation, of the neck over a determined length (1) equal to the distance between the planes (Lg) and (Lr).

BRIEF DESCRIPTION OF THE DRAWINGS

The invention will be better understood by means of the following explanations and the appended figures, of which.

For greater clarity, the same elements bear the same references in all the figures.

Figure 1:
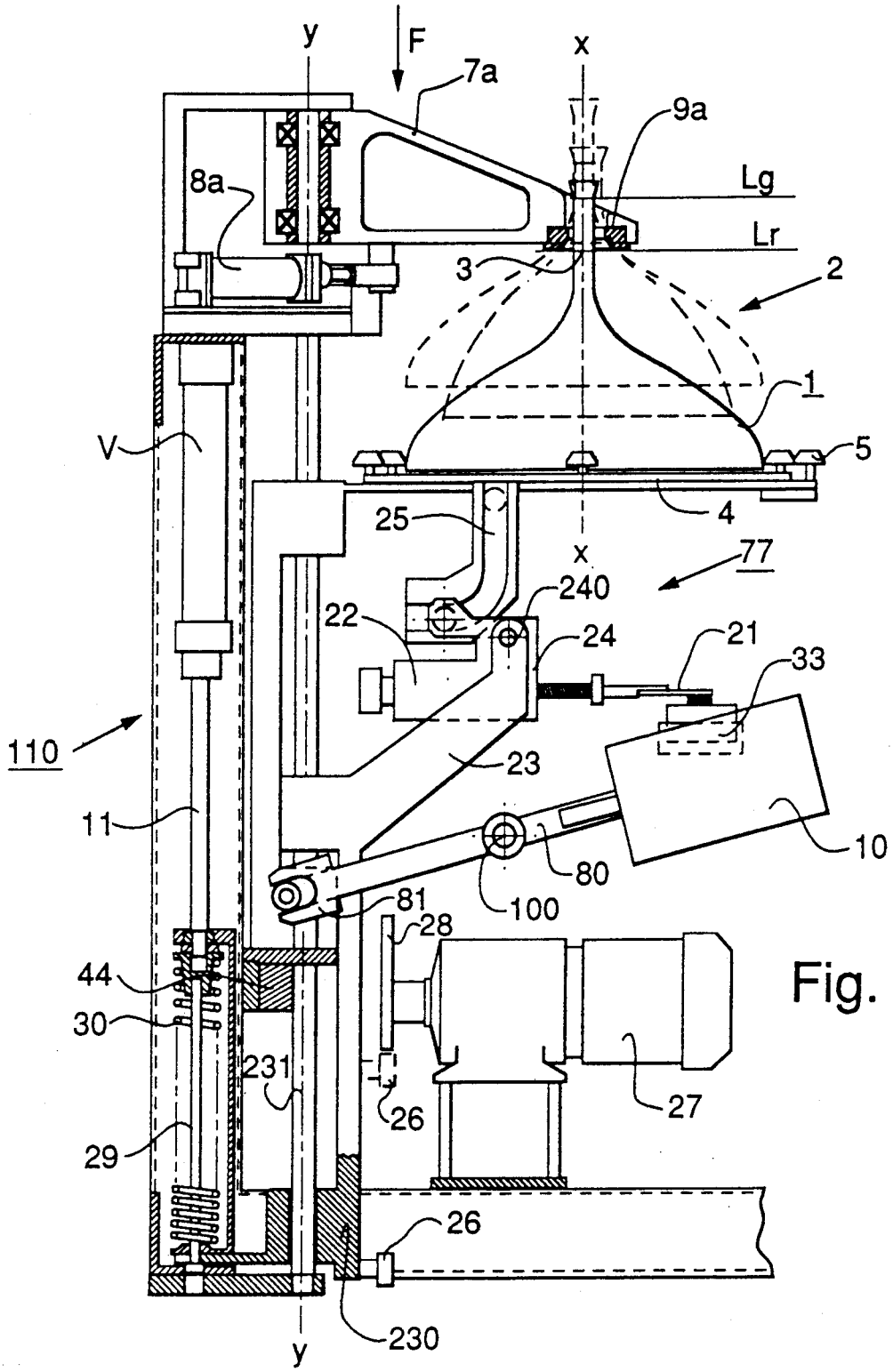
FIG. 1 is a schematic illustration of a device according to the invention.

As shown in the figures which give a schematic view of a device according to the invention, said device essentially consists of:

a frame (110);

a sub-unit (2) formed by a supporting table (4) on which the cone (1) rests, this supporting table (4) being fitted out with a system of stops for centering the cone in a horizontal table, this supporting plane (4) being capable of achieving translational motion in a vertical plane;

first and second arms (7*a*) and (7*b*) fitted out respectively with a collar (9*a*) and (9*b*) having a supporting face against which the cone (1) abuts during the upward movement of the supporting table (4), said supporting face demarcating a reference line plane (Lr);

a graphitization system (77) proper, the motion of which is, firstly, related to the vertical translational motion of the supporting table (4) and, secondly, guided by means of a groove (21) with a configuration of its profile and a positioning that lead the graphitization brush (24) up to the table (Lg) which is the boundary of the zone of the neck (3) to be graphitized;

a set of jacks, motors, springs, etc., solidly joined to the frame, making the different elements of the device work together.

Figure 2:
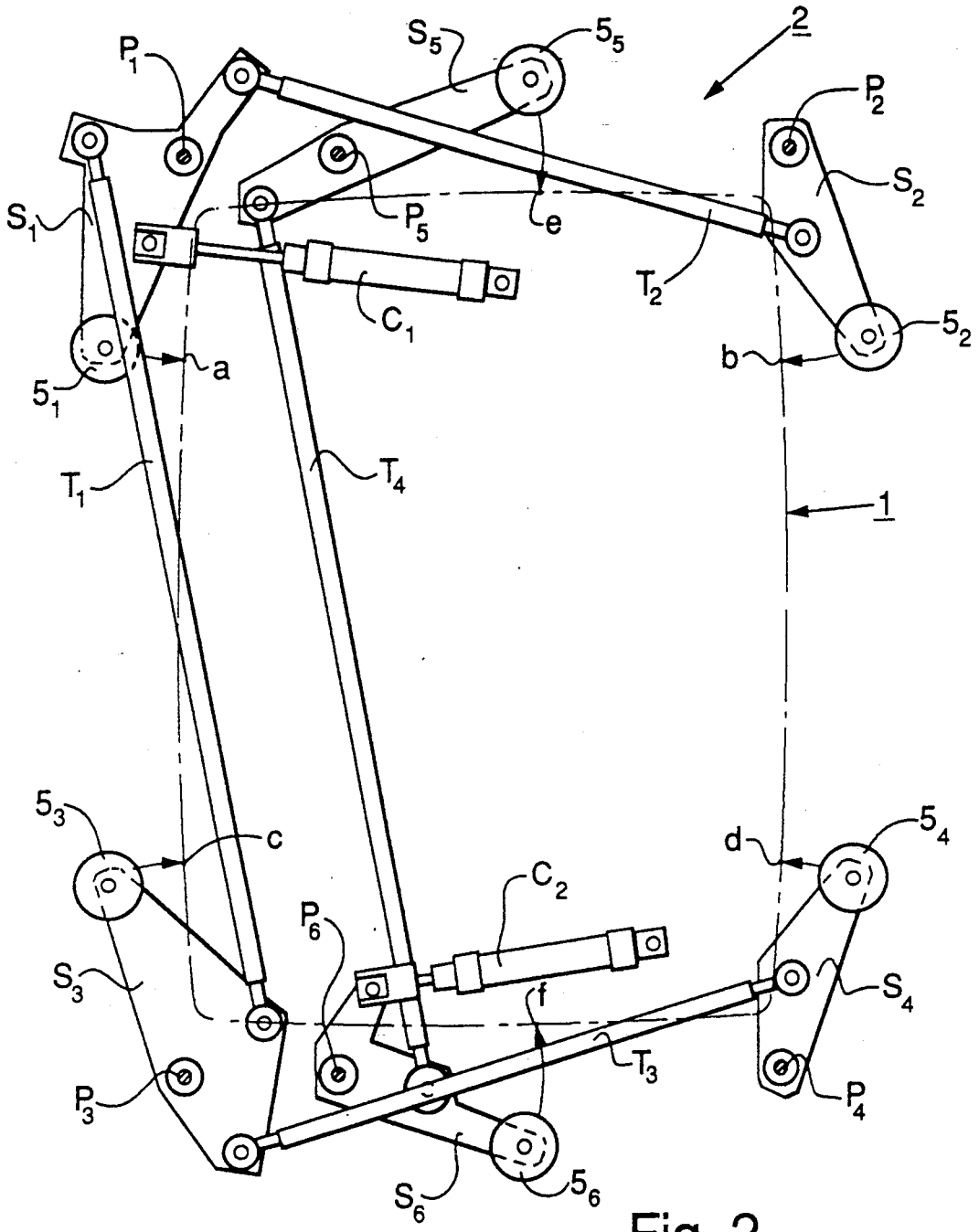
FIG. 2 is a diagram illustrating a part of the device of FIG. 1.

The working and description of the device according to the invention shall be dealt with simultaneously by means of FIGS. 1 and 2.

A frame (110) bears all the elements forming the device and, notably, the supporting table (4) of the cone (1) for which the internal surface of the neck (3) has to be graphitized.

This supporting table (4) is fitted out, according to one characteristic of the invention, with a plurality of stops, for example six stops, called centering stops, the structure and working of which are illustrated by means of FIG. 2.

It is seen that each of these six stops ($\mathbf{5}_1$, $\mathbf{5}_2$, $\mathbf{5}_3$, $\mathbf{5}_4$, $\mathbf{5}_5$, $\mathbf{5}_6$) is associated with an independent support ($S_1$, $S_2$, $S_3$, $S_4$, $S_5$, $S_6$) having an also independent rotation point (P1, P2, P3, P4, P5, P6) solidly joined at one end to the supporting table (4).

The links between these supports are achieved by four push rods (T1, T2, T3, T4) having lengths constant for each rod, but not identical to one other, associated with the supports ($S_1$, $S_2$, $S_3$, $S_4$, $S_5$, $S_6$) in such a way that, under the effect of two base centering jacks ($C_1$) and ($C_2$), the six stops ($\mathbf{5}_1$, $\mathbf{5}_2$, $\mathbf{5}_3$, $\mathbf{5}_4$, $\mathbf{5}_5$, $\mathbf{5}_6$) grip the base of the cone (1) shown schematically by means of dots and dashes in this FIG. 2.

It must be noted that the base centering jack ($C_1$) controls the support ($S_1$) and that the base centering jack ($C_2$) controls the support ($S_6$). Each independent jack cooperates respectively with push rods and pull rods (T1, T2, T3) and with the rod (T4) to act upon the supports by a pantograph effect and thus bring all the stops into contact with six points (a, b, c, d, e, f) of the rim of the cone (1) which thus gets almost perfectly centered, along a vertical axis (xx) which corresponds to the axis of the neck (3) of the cone 1.

In FIG. 1, the graphitization device (77) is shown with the cone (1) (in solid lines) placed on the supporting table (4) and centered (4) by the six stops ($\mathbf{5}_1$) to ($\mathbf{5}_6$). Only one of these stops is arbitrarily marked (5) without any index on this figure.

The cone 1 is therefore centered in a horizontal plane on the supporting table (4), itself in a low position. It is possible to see, in FIG. 1, two other cones, symbolized by dashes, which are in this case, is in a top position because, as shall be explained further below, the supporting table (4) can change position vertically from a bottom position to a top position. One of the cones has a deflection angle of 90° and the other has a deflection angle of 110°.

Figure 3:
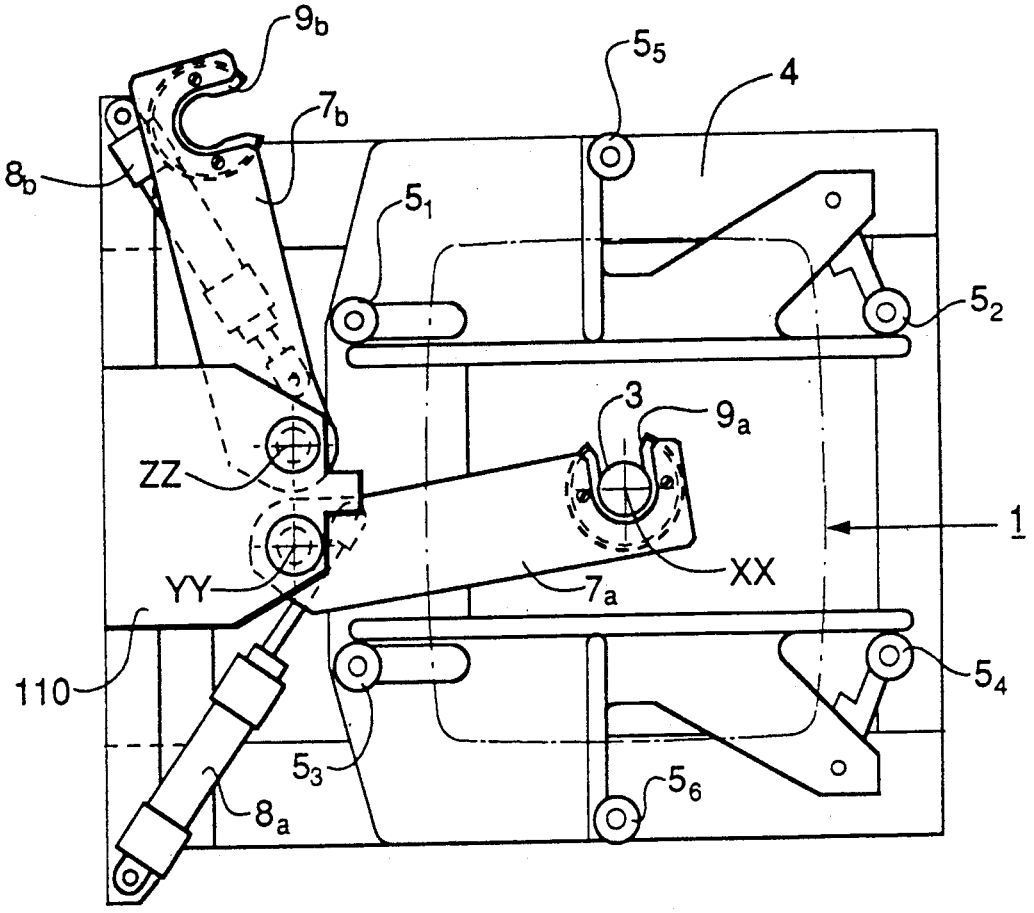
FIG. 3 is a top view of the device along the arrow (F) of FIG. 1.

According to one characteristic of the invention, the first and second arms (7a) and (7b), solidly joined to the frame (110), can be seen in FIG. 3, while only one is shown in FIG. 1 under the reference (7a).

Each of the first and second arms (7a) and (7b), rotating on an axis (yy) and (zz), is fitted out with a collar (9a) and (9b) adapted to the external configuration of the necks (3), which varies as a function of the deflection angle of the cone (1) concerned. Thus, as shown in a sectional view in FIGS. 4a and 4b, the profiles of the supporting tables are machined in such a way that the collar (4a) is adapted to the 110° cone while the collar (4b) is adapted to the 90° cone.

Figure 4B:
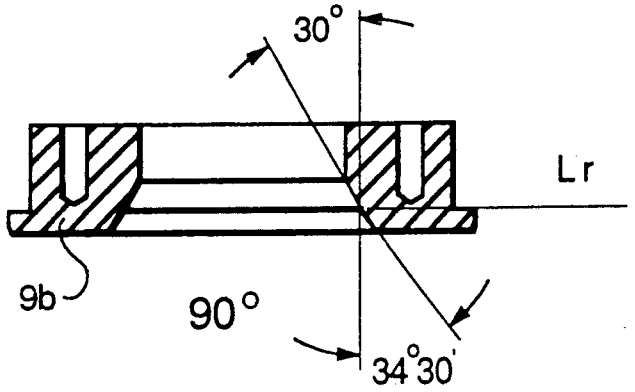
FIGS. 4*a* and 4*b* are sections of collars for centering 110° and 90° cone necks.
Figure 4A:
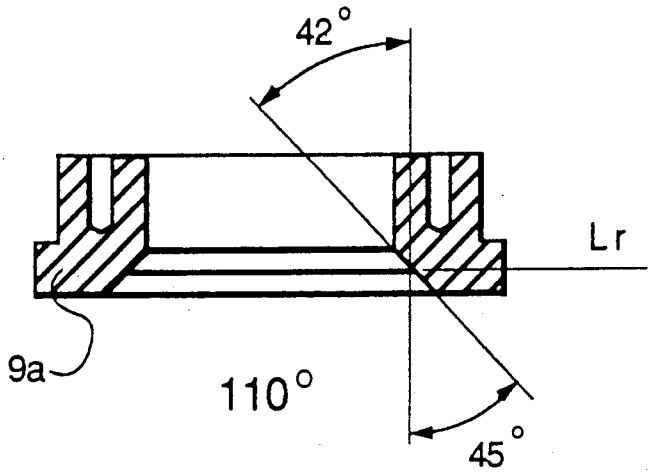

It can also be seen, in FIGS. 4a and 4b, that the angles chosen for the machining of each of the cones of the collars is different and, this is so in order to obtain a generatrix against which the cone (1) comes to a stop during the upward movement of the supporting table (4). This generatrix is then the reference line or plane (Lr).

Before this step of the upward movement of the supporting table (4), the concerned arm (7a) or (7b) is oriented by rotation on the axis (yy) or (zz) by means of an arm jack (8a) or (8b) in such a way that the axis (xx) of the collar (9a) or (9b) coincides with the axis (xx) of the neck (3). The supporting table (4) is then translated upwards until the cone is supported on the reference line (Lr) of the concerned collar. Under these conditions, the neck (3) is automatically, precisely and reproducibly centered and positioned for the proper height. This translation of the supporting table (4) is achieved as described below.

Since the collar (9a) or (9b) is placed on the axis (xx), a force on a primary jack (V), inserts a jack rod (11) therein which raises a reinforcement (230), guided by a column (231), that is solidly joined both to a graphitization arm (23), bearing the graphitization system (77), and to the supporting table (4). The upward movement of the supporting table (4) is assisted by a counterweight (10) placed at the end of a counterweight arm (80) that is terminated, at its other end, by a fork (81) to control the upward movement of the supporting table (4). This counterweight arm (80) pivots on an axis (100), and does so until the summit of the cone (1) comes into contact with the reference line (Lr) of the concerned collar (9a) or (9b).

The upward movement of the supporting table (4) is accompanied by the movement of the graphitization system (77) which continues until the reinforcement (230) contacts an upward movement limit stop (44).

This graphitization system (77) is formed by a brush (21) and its support that rotates eccentrically with respect to the axis of a first motor (22).

The brush/motor set (21-22) is fixed to a lever (24), which is itself hinged on the graphitization arm (23) along the axis (240).

In the idle position, the brush/motor set (21-22) is in horizontal position. During the upward movement of the rod (11) of the jack (V), the graphitization arm (23) is raised and causes the rotation, on the axis (240), of the lever (24) and the brush (21) which is solidly joined to it.

According to one characteristic of the invention, the level (23) follows the profile of a groove (25) during this upward movement, thus leading to the obtaining, at the end of travel, of the operational vertical position of the brush (21) which also gets positioned along an axis parallel to the axis (xx) of the neck (3) since the axis of the brush (21) is off-centered with respect to the axis of the first motor. The combination between the profile and the sizing of the groove (25), on the one hand, and the fixed position of the collar (9a) or (9b) and of the concerned arm (7a) or (7b) as well as the stop (44), on the other hand, enables the top of the graphitization plane (Lg) to be determined precisely and repetitively.

Figure 5:
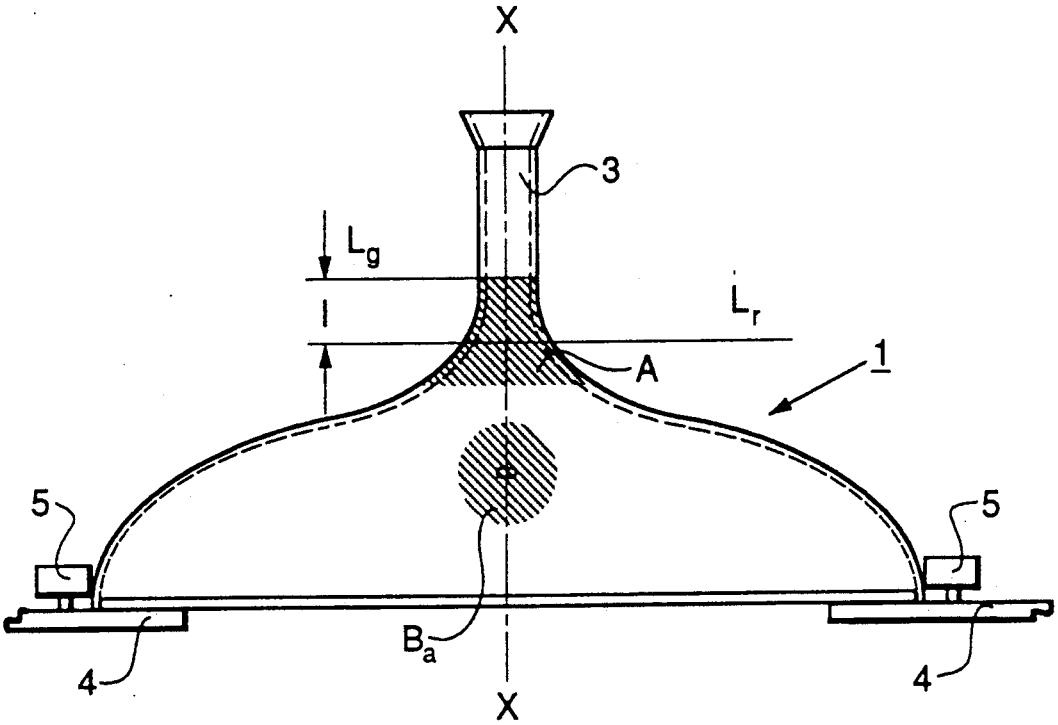
FIG. 5 is a drawing illustrating a cathode-ray tube, the cone neck of which been coated with graphite by means of the device according to the invention.

When the first motor (22) is started, it transmits, to the brush (21), a rotational motion which, owing to its off-centering, will coat the neck (3) with graphite collected in a container (33). During the application of the graphite, it is nevertheless necessary to communicate a downward motion to the brush so as to ensure the bonding of the graphite at the bottom of the neck (3) with the graphite of the cone (1) (FIG. 5).

This downward motion of the brush (21) is achieved, then, according to the method described below.

The graphitization arm (23)/lever (24) unit is provided at its base with a post, and (26) in contact with a cam (28) connected to a second motor (27).

In the operating position of the device, the brush (21) is in the top position, the post (26), fixedly attached to the graphitization arm (23), also is in the top position (it is then shown with dashes) and, in this situation, the cam (28) of the second motor (27) is adapted so that it is in its minimum travel as can be seen in FIG. 1.

The result thereof is that the starting of the second motor (27) and, consequently, the rotation of the cam (28) drives the graphitization arm (23) downwards and, therefore, by effect of contact, causes the descent of the brush (21) which, in continuing to rotate, spreads its graphite over a height corresponding to the maximum travel of the cam (28). It is important to note that, during the descending operation of the brush (21) due to the effect of the cam (28) on the post (26), the cam/post contact is obtained through the effect of a rod (29) which comprises a spring (30). During this stage of the descent of the brush, the supporting table (4) retains its position.

One of the major characteristics of this mechanism is that the combination between the profile of the cam (28), on the one hand, and the rotation speed of this very same cam (28), on the other hand, enables a large number of possibilities of vertical sweeping, causing slow and fast descending motions that effect, among other factors, the thickness and the distribution of the graphite layers to be deposited.

When the graphitization operation is over, the operations reverse to those just described are performed.

Release of the force on the jack (V) withdraws the jack rod (11). The graphitization arm (23) and the brush (21) descend, simultaneously lowering the counterweight arm (80) of the counterweight (10) thus assisting in the lowering the supporting table (4) with its cone (1) with the graphitized neck (3).

The base centering jacks ($C_1$) and ($C_2$) will then open and release the stops ($5_1$, $5_2$, $5_3$, $5_4$, $5_5$, $5_6$). The arm jack (8) will cause the release of a graphitization arm (7) and, consequently, that of the collar (9).

The treated cone (1) will then be withdrawn either by hand or mechanically, and the loading of another cone can be done.

As FIG. 5 shows, the combination of the means applied in the deice according to the invention makes it possible to obtain a graphitization zone with a length (1) between the reference table (Lr) and the plane (Lg) corresponding to the maximum height reached by the graphitization brush (21).

Furthermore, through the configuration of the cam (28) working together with the post (26), the graphitization zone can be extended beneath the reference table (Lr) in such a way that it overlaps the graphite already deposited inside the cone, prior to its processing by means of the device according to the invention. This overlapping zone is marked (A) and is shown in FIG. 5 with crossed hatched lines. An anode button (Ba) is shown for reference.

With this device, there may be associated systems for the automatic loading and unloading of the cones. The cones also may be fed by hand, with the automated system coming into play only in the device itself and according to steps of the above-described method.

This device has a great many advantages. In particular, it can be adapted to two types of cone (with deflection angles of 90° and 110°). It enables certainty with respect to the upper boundary (Lg) of the graphitization of the neck (3) through a graphitization system (77) using a brush (21) that is automatically positioned at the maximum graphitization height (Lg). It also can be used to adjust the rotation speed of the brush (21) and its descending speed during the graphitization stage. It is a device fitted out with all the centering and guidance means needed to obtain a constant thickness of graphite, with a well-demarcated height, in doing so automatically and reproducibly.

The invention can be applied, notably, to the manufacture of cathode-ray tubes.

I claim:

1. A method for applying an internal conductive coating to a surface of a neck of a cathode-ray tube cone along a length extending from a coating plane to a reference plane, the method including the steps of positioning a base of a cathode-ray tube cone on a supporting table of a coating device, orienting a collar about the neck of said cone, said collar having a supporting face demarcating a reference plane, centering said cone in a horizontal plane on said supporting table so that a vertical axis of said collar coincides with a vertical axis of said neck, raising said supporting table carrying said cone to a position at which said cone contacts said supporting face of said collar to establish a reference plane relative to said cone, raising a coating system including an arm having a brush/motor set pivotably attached thereto by a hinge, said brush/motor set being rotatable from a horizontal position to a vertical position as said arm is raised, a brush of said brush/motor set being disposed within said neck, parallel to and offset with respect to the axis of said neck, at said coating plane, energizing said brush/motor set to provide rotational motion to said brush to apply a uniform conductive coating to said neck, initiating downward motion of the rotating brush from said coating plane to at least said reference plane while retaining said supporting table in the raised position, said downward motion being provided by a second motor having a cam which contacts a post fixedly attached to said arm, said cam driving said arm downward to a point of maximum travel of said cam, thereby lowering said brush of said brush/motor set through said neck of said cone.

2. A device for applying an internal conductive coating to a surface of a neck of a cathode-ray tube cone along a length extending from a coating plane to a reference plane, said device comprising a frame having at least one arm with a collar which adapts to the neck of said cone, said collar having a supporting face demarcating said reference plane, a table for supporting a base of said cone, said table being provided with means for centering the base of said cone and means for vertically moving said table so that said cone contacts said supporting face of said collar at said reference plane, and internal coating means for contacting said surface of said neck at said coating plane and applying a coating of a suitable conductive material thereto from said coating plane at least to said reference plane.

3. A device for the graphitization of a neck of a cathode-ray tube cone to a height determined by a graphitization plane; the device comprising, mounted rotationally on a frame, two arms each fitted out, respectively, with a collar, the profile of which can be fitted to the deflection angle of the cathode-ray tube, said collar mounted for working together with a supporting table capable of being translated in a vertical plane and provided with means for centering a base of the cone on the table, for centering the neck of the cone along its axis, and for determining a reference plane for the graphitization operation of the neck over a predetermined length, equal to the distance between the graphitization and reference planes, and means for coating the neck with graphite.

4. The device according to claim 3, further comprising a cam connected to a motor mounted for working together with a post fixedly attached to the graphitization arm, the profile of the cam being such that its rotation forces the graphitization arm downwards, hence the brush spreads graphite at least to the reference plane, and means for retaining the supporting table in its upward position during the graphitization of said neck.

5. The device according to claim 4, wherein the combination of the profile of the cam and of the rotational speed of the motor which controls it are such as to enable variation of the descending speed of the brush during the graphitization of said neck.

6. The device according to claim 3, wherein the table is elevatable by means of a jack having a jack rod which is attached to a reinforcement guided by a column, the reinforcement being attached both to a graphitization arm bearing said means for coating and to the supporting table.

7. The device according to claim 6, wherein a counterweight is positioned at the end of a counterweight arm pivotable about an axis to assist motion of the supporting table.

8. The device according to claim 6, wherein said means for coating includes a brush and its support rotatable eccentrically with respect to an axis of a motor forming a brush/motor set, the brush/motor set being fixed to a lever hinged on the graphitization arm along an axis in such a way that in an idle position, the brush/motor set is in a horizontal position.

9. The device according to claim 8, wherein said means for coating includes means for guiding the lever so that, during the upward motion of the jack rod, the graphitization arm is lifted, thus causing the rotation on the axis of the lever, and the brush is placed in a vertical position parallel to the axis of the neck of the cone.

10. The device according to claim 9, wherein when in the top position, the brush is at the level of the graphitization plane.

11. The device according to claim 9, wherein the brush is positionable off center relative a said tube and when the brush is in the top and maximum position the motor can communicate a rotational motion to the brush which due to being off center can coat the neck of the tube with graphite.

* * * * *

UNITED STATES PATENT AND TRADEMARK OFFICE

CERTIFICATE OF CORRECTION

PATENT NO. : 5,051,276

DATED : Sept. 24, 1991

INVENTOR(S) : Arturo Sbordone

It is certified that error appears in the above-identified patent and that said Letters Patent is hereby corrected as shown below:

Col. 2, line 15, delete "line".

Col. 2, line 19, change (21) to --(25)--.

Col. 2, line 21, change "table" to --plane--.

Col. 2, line 63, after "centered" delete "(4)".

Col. 3, line 17, change "tables" to --planes--.

UNITED STATES PATENT AND TRADEMARK OFFICE

CERTIFICATE OF CORRECTION

PATENT NO. : 5,051,276

DATED : Sept. 24, 1991

INVENTOR(S) : Arturo Sbordone

It is certified that error appears in the above-identified patent and that said Letters Patent is hereby corrected as shown below:

Col. 3, line 20, change "can also"
to --also can--.

Col. 5, line 9, change "table"
to --plane--.

Signed and Sealed this

Thirteenth Day of April, 1993

*Attest:*

STEPHEN G. KUNIN

*Attesting Officer*

*Acting Commissioner of Patents and Trademarks*